US006238319B1

(12) United States Patent
Young

(10) Patent No.: US 6,238,319 B1
(45) Date of Patent: May 29, 2001

(54) PORTABLE ATHLETIC STARTING BLOCK

(75) Inventor: Elmer Young, Mesa, AZ (US)

(73) Assignee: BuddBlock, Inc., Mesa, AZ (US)

( * ) Notice: Subject to any disclaimer, the term of this patent is extended or adjusted under 35 U.S.C. 154(b) by 0 days.

(21) Appl. No.: 09/436,098

(22) Filed: Nov. 8, 1999

(51) Int. Cl.[7] ..... A63B 69/00
(52) U.S. Cl. ..... 482/19; 73/379.01
(58) Field of Search ..... 482/80, 19, 79; 73/379.01, 379.08, 865.4

(56) References Cited

FOREIGN PATENT DOCUMENTS

2110214 * 9/1971 (DE) ..... 482/19
2232894 * 1/1991 (GB) ..... 482/19

OTHER PUBLICATIONS

Track & Field Equipment Catalogue; pp. 32 & 33.

* cited by examiner

*Primary Examiner*—Jerome Donnelly
(74) *Attorney, Agent, or Firm*—LaValle D. Ptak

(57) ABSTRACT

A portable starting block, used by track athletes, is constructed of sections of two lightweight aluminum extrusions. One of these extrusions comprises a foot pedal portion having a generally concave, outwardly facing, foot-engaging portion with an inwardly turned track-engaging end. The other portion of the starting block is a support plate, which also has a track-engaging end and an upper end for pivotal interconnection with the foot pedal portion. The pivotal interconnections are formed as mating extrusions, one of which slides into the other to form a movable hinge between the two portions of the starting block. This permits any desired incremental angle adjustment of the starting block within a fairly wide range of angles. The two parts are locked together by a locking pin; and when the block is folded into its storage position, the foot pedal portion underlies the support plate portion.

24 Claims, 3 Drawing Sheets

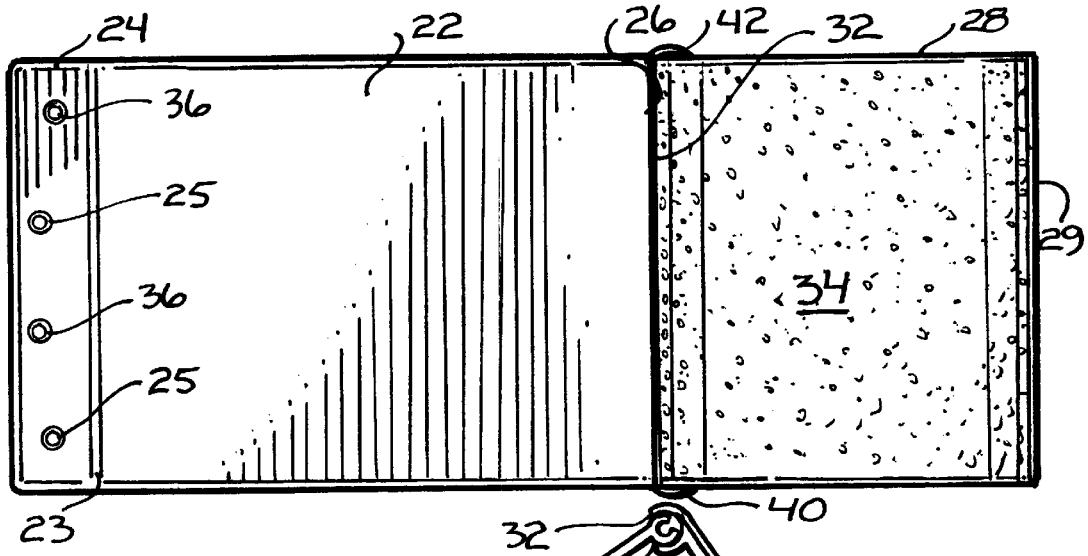
FIG. 3
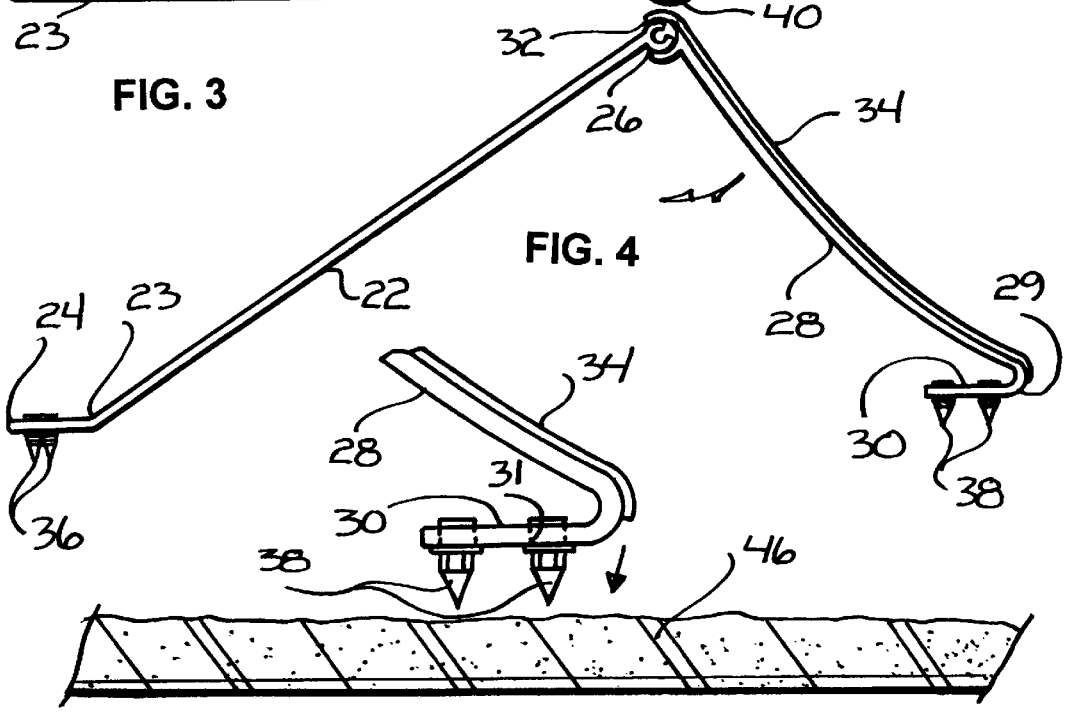
FIG. 4
FIG. 5
FIG. 6
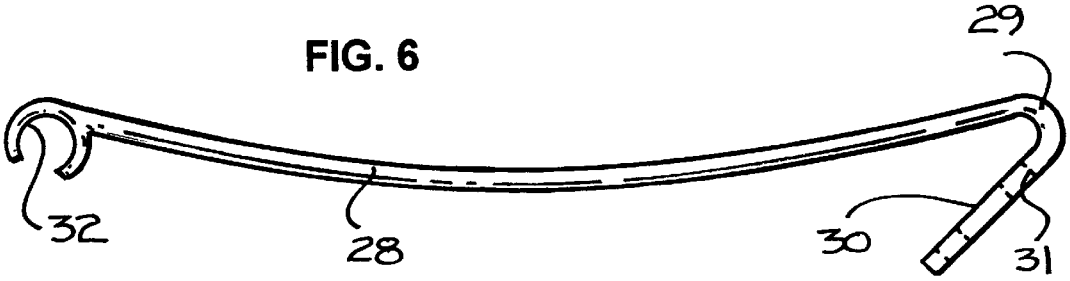

PORTABLE ATHLETIC STARTING BLOCK

BACKGROUND

Starting blocks for runners are in widespread use in conjunction with field and track events,. These starting blocks include an elongated central channel member having a length of between 24" and 30". This channel member, for many starting blocks, has holes at each end; and pins or stakes are driven into the track through these holes to hold the channel member in place. For some starting blocks, a plurality of spikes extending from the bottom of the channel member are used to anchor the starting block assembly in the desired location, adjacent the starting line for an individual runner.

Known starting blocks also include foot pedals on each side of the central channel member. These foot pedals have a somewhat concave-shaped surface on them, extending upwardly at an angle from the portion adjacent the track. The foot pedals are mounted on opposite sides of the channel member in positions established by fixed incremental slots or holes. The foot pedals then are held in place by means of spring-loaded pins or other suitable mechanical devices. The location of the foot pedals along the length of the channel member thus is incrementally established in accordance with the pre-set distances between the slots or holes on each side of the channel member.

The center channel member of conventional starting blocks is approximately two inches wide; and the foot pedals then extend on opposite sides of the channel member. Thus, the foot pedal spacing is fixed by the width of the channel. The angular slope of the foot-engaging surface of the foot pedals, for some starting blocks, is adjustable in fixed increments. Typically, these adjustments are pre-set at three or four different angles, or may be in 10° increments, or some other fixed incremental angular spacing. If a runner found the most comfortable position to be something between the incremental settings available with a particular starting block, however, no provision for infinitely adjustable setting over a pre-established range is possible with these blocks.

In addition to the limitations mentioned above, the starting blocks known in the prior art are quite bulky and heavy. This makes them relatively difficult to transport from one location to another. Athletes, however, frequently practice and compete on different tracks, and necessarily need to carry their starting blocks with them from one location to another. Because of the bulk of standard starting blocks, this presents an addition annoying burden.

It is desirable to provide an inexpensive, lightweight, fully adjustable track starting block which overcomes the disadvantages of the prior art, and which is easy to use and simple to manufacture.

SUMMARY OF THE INVENTION

In accordance with a preferred embodiment of the invention, a portable athletic starting block comprises two interconnected portions. The first of these is a foot pedal portion, which has a track-engaging end and an upper end. The second is a support plate portion, which has a track-engaging end and an upper end. The upper ends of both of the portions of the starting block are rotatably interconnected together by means of mating members on the upper ends, respectively, of the foot pedal portion and the support plate portion. This rotatable interconnection allows a predetermined rotational movement of the track-engaging ends of the two portions of the starting block toward and away from one another to adjust the angle of the foot pedal portion, with respect to a track surface. Track-engaging members then are applied to the track-engaging ends of the foot pedal portion and the support plate portion to hold the starting block in place on a track.

A pair of these starting blocks, which are independent of one another, are utilized; so that the relative fore and aft and side-to-side spacing of the blocks may be individually tailored to the particular athlete using the set of blocks.

BRIEF DESCRIPTION OF THE DRAWINGS

FIG. 3 is a top view of the embodiment shown in FIG. 1 reversed from left to right from the view shown in FIG. 1;

FIG. 4 is a side view of the embodiment shown in FIG. 3;

FIG. 5 is an enlarged detail of a portion of the embodiment shown in FIG. 4;

FIG. 6 is a side view of one of the parts shown in the embodiment of FIGS. 3 and 4;

DETAILED DESCRIPTION

Figure 1:
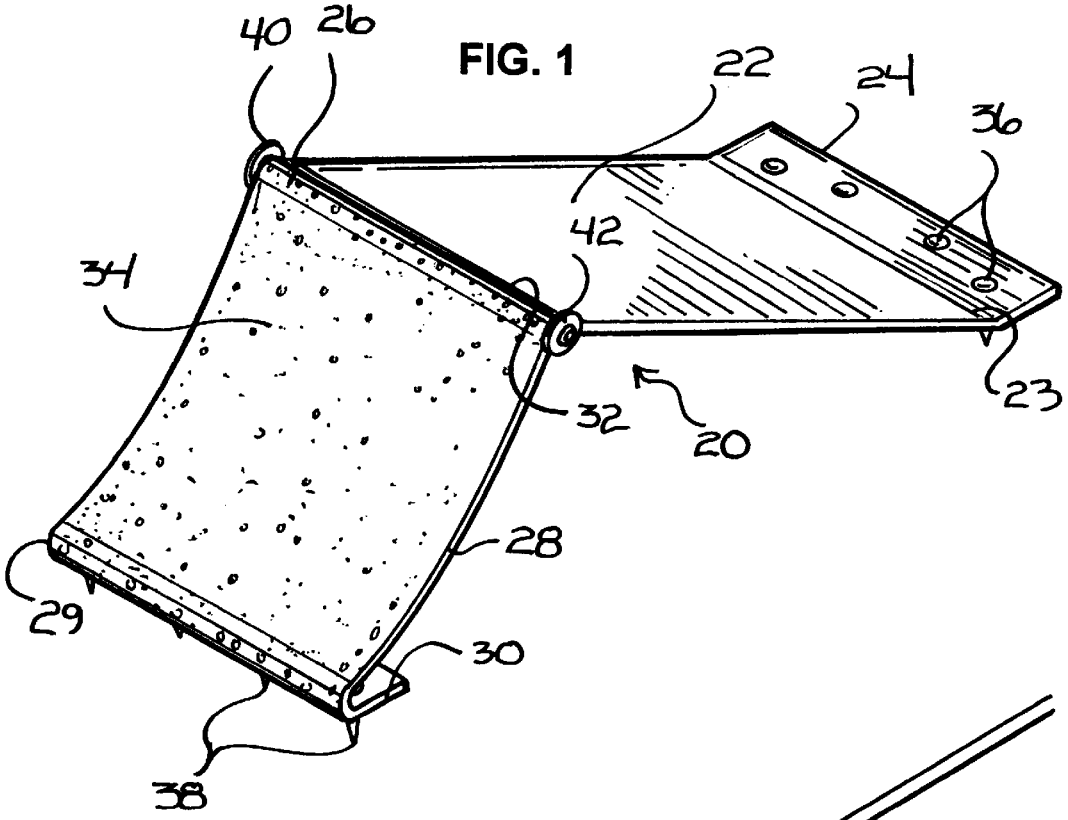
FIG. 1 is a top perspective view of a preferred embodiment of the invention.
Figure 7:
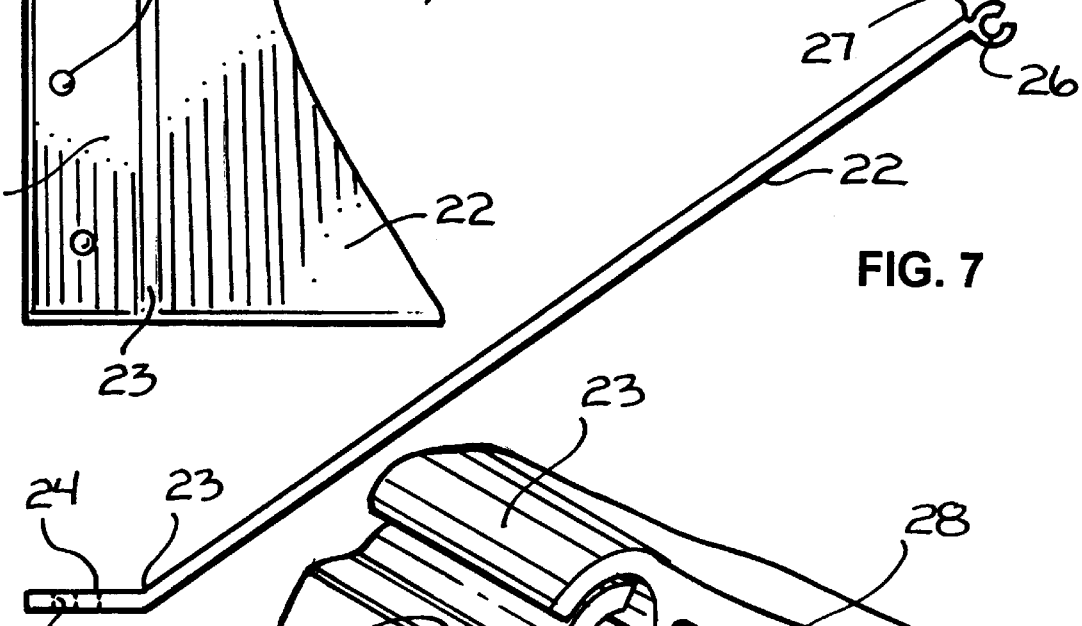
FIG. 7 is a side view of another one of the parts shown in the embodiment of FIGS. 3 and 4.

Reference now should be made to the drawings, in which the same reference numbers are used throughout the different figures to designate the same elements. FIG. 1 is a top perspective view of a portable athletic starting block 20 constructed in accordance with a preferred embodiment of the invention. The starting block 20 of this invention consists of two primary parts. The first of these is a support plate 22, which, as seen most clearly in FIGS. 3, 4 and 7, is an elongated substantially flat rectangular plate with an outwardly turned flange 24 at the track-engaging end thereof. This flange is joined at a bend 23 to the main portion of the plate 22. The upper end of the support plate 22 terminates in a generally C-shaped, elongated hinge portion 26 adjacent a shelf abutment 27 at the upper edge of the plate 22.

The other primary portion of the portable athletic starting block consists of a foot pedal 28, shown most clearly in FIGS. 1, 4 and 6. The foot pedal 28 has a generally concave outer or foot-facing surface on it, which is coated with a coating 34 made of sprayed-on, non-skid polyurethane material (shown most clearly in FIGS. 5 and 9). The coating material 34 adheres tightly to the outer or facing surface of the foot pedal 28; and polyurethane has been found to resist tearing by the spikes used on the bottom of track shoes. The lower or track-engaging edge of the foot pedal plate 28 is an inwardly turned flange 30, formed at a bend 29. The upper end of the foot pedal plate 28 terminates in a C-shaped hinge portion 22, which has an internal diameter slightly larger than the external diameter of the portion 26 on the support plate 22.

As readily can be ascertained from an examination of FIGS. 4, 6 and 7, in particular, the support plate and the foot pedal plate, along with their track-engaging flanges and the hinge portions at their upper edges, each may be made from elongated extrusions, preferably of aluminum. The plates 22 and 28 then are formed as sections of these extrusions. This greatly simplifies the manufacture of the starting block from the starting blocks used in the past.

The track-engaging flange 24 of the support plate 22 and the inwardly turned track-engaging end 30 of the foot pedal plate 28 have a series of threaded, offset holes 25 and 31 located in them for the application of track-engaging spikes 36 and 38, respectively. The track-engaging spikes 36/38 may be of any suitable conventional structure, and are designed to be removably inserted into the holes 25 and 31. Consequently, spikes of different types and lengths may be inserted into the holes in accordance with the particular track surface on which the starting block is to be used.

Figure 9:
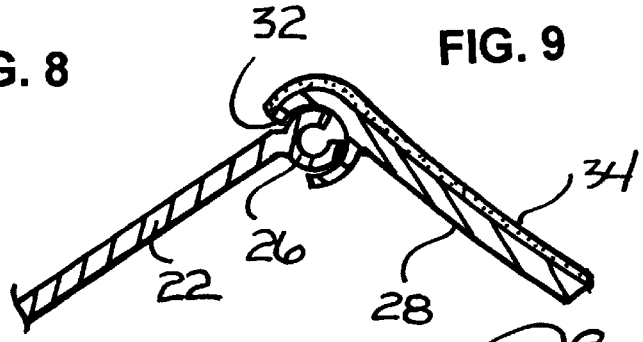
FIG. 9 is an enlarged detail illustrating some of the parts of the embodiment shown in FIGS. 3 and 4.
Figure 10:
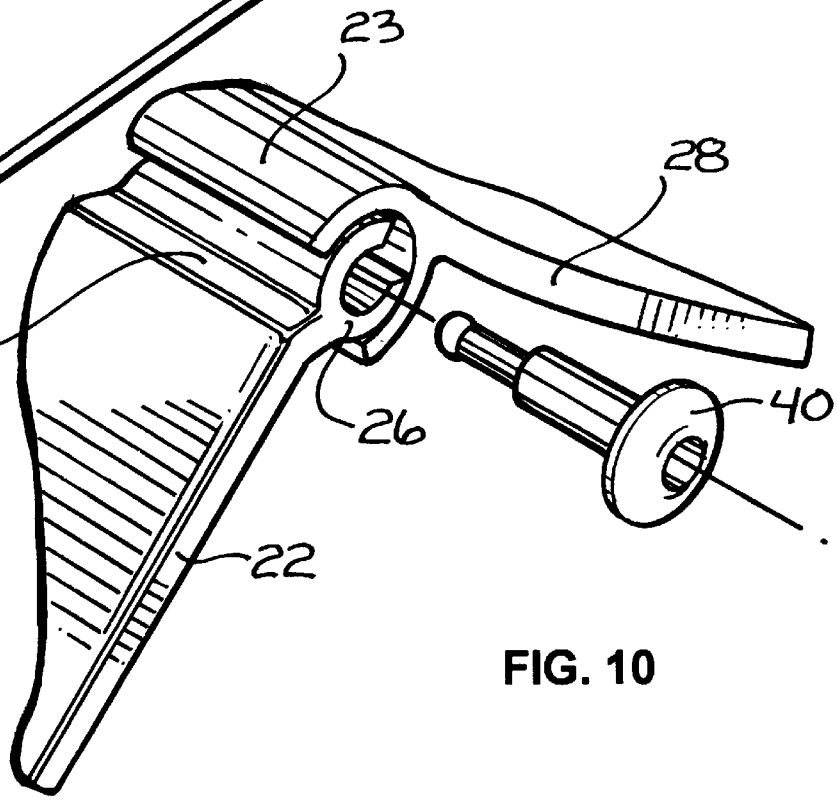
FIG. 10 is an enlarged detail illustrating a manner of interconnecting the parts shown in FIGS. 6 and 7.

To assemble the individual support plates 22 and foot pedal plates 28 together,. the generally C-shaped elongated extrusion 26 on the top of the plate 22 is slid from one edge into the opening on the edge of the extrusion 32 formed on the top of the foot pedal plate 28 form an interconnecting hinge, shown most clearly in FIGS. 3, 9 and 10. The internal diameter of the opening in the extrusion 32 is slightly larger than the external diameter of the extrusion 26; so that relative pivoting of the two plates 22 and 28 toward and away from one another, in the direction of the double-ended arrow shown in FIG. 4, may be effected. The shape of the extrusions and of the location at the end of the plates is such that when the device is to be stored or carried, the foot pedal 28 may be rotated to a position immediately adjacent the underside of the support plate 22. This places the track-engaging end 30 on the lower end of the plate 28 next to the underside of the plate 22.

When the device is to be used, it is opened to the position shown in FIGS. 1, 2, 3, 4, 9 and 10. In particular, FIGS. 3, 9 and 10 show the manner in which the two parts may be relatively rotated with respect to one another. The edges of the C-shaped extrusion 32 on the end of the foot pedal plate 28 establish the limits of rotation by engaging either an upper shoulder 27 (shown most clearly in FIG. 10) on the plate 22, or the underside of the plate 22. The maximum amount of angular settings for the starting block 20 is established by the relative dimensions of the extrusion 32 and the manner in which the extrusion 26 is located on the end of the plate 22.

Figure 2:
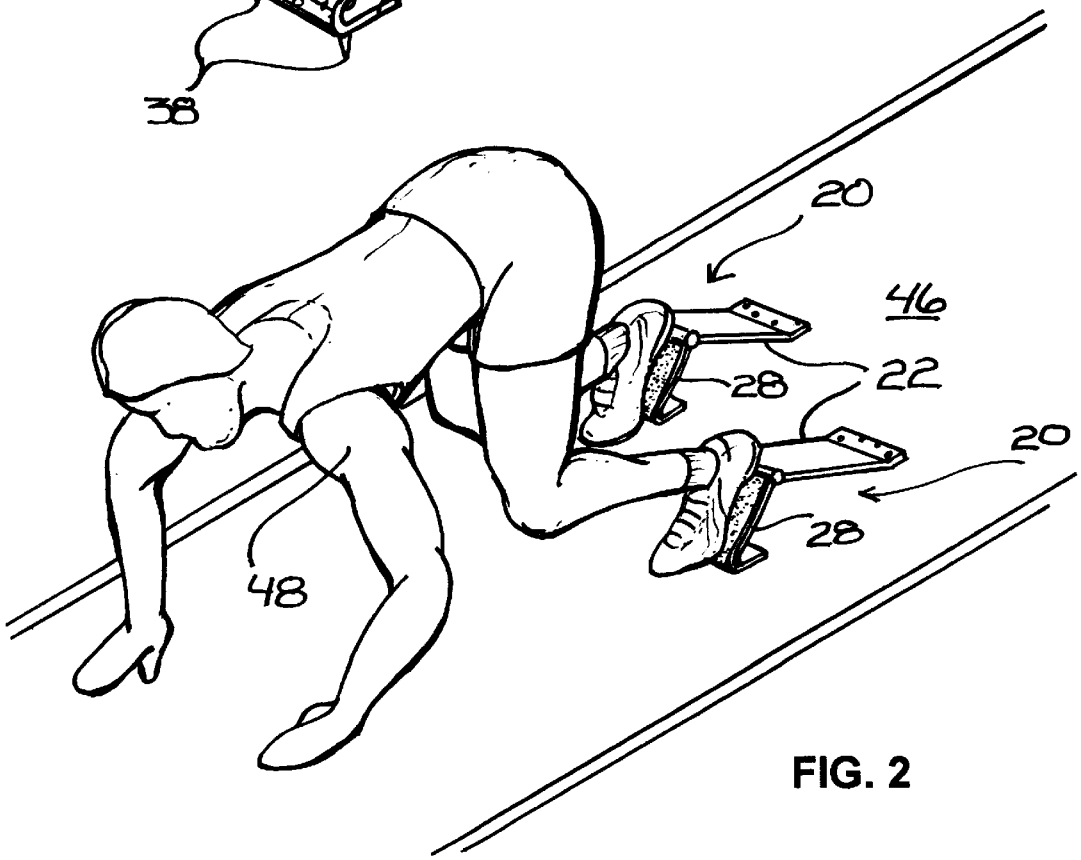
FIG. 2 is a perspective view showing a pair of the blocks of the preferred embodiment of the invention as they are used by an athlete.
Figure 8:
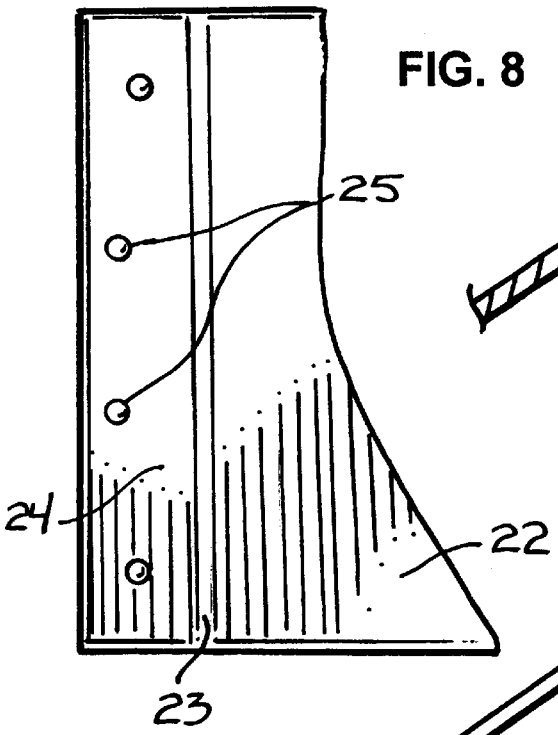
FIG. 8 is an enlarged view of a portion of the part shown in FIG. 7.

Within the range of adjustments permitted by the parts, as illustrated in FIGS. 3, 9 and 10, the athlete has an infinite degree of adjustment of the angle of the foot pedal 28 with respect to the track surface 46 on which the device is located, as illustrated in FIGS. 2 and 5. There are no pre-set increments or pre-set angular positions (other than the extremes for the widest setting and the folded storage setting) to be encountered. Exactly the right angle may be provided for each individual preference. Once the angle is established, the pins or track spikes 36 and 38 are pushed into the track surface 46 to locate the starting blocks 20 in the desired position on the track surface 46.

Clearly, as shown in FIG. 2, the starting block of FIG. 1 is designed to be used as one of a pair or set of two blocks. The two blocks may be placed at any desired distance apart for the comfort of the athlete. There is no restriction on the distance between the blocks, as is the case with standard starting blocks using a single central elongated channel. Nothing interconnects the two blocks to one another; so that they may be placed fore and aft at any desired spacing distance, as well as being spaced apart to a distance which uniquely suits the preference of the runner using the set of starting blocks.

To ensure that the foot pedal plate 28 and the support plate 22 do not disengage or misalign from one another, locking pins 40 and 42 are provided once the parts have been assembled together in the manner described above. FIG. 10 shows an enlarged view of such a locking pin 40. It includes a small lead-in portion, and then has a shank which firmly frictionally fits into the interior diameter of the. extruded hinge portion 26 on the end of the block 22. The flanges on the locking pins 40 and 42, on opposite sides of the assembly, overlie the edges of the extruded hinge portion 32 on the end of the foot pedal 28; so that all of the parts maintain assembled condition, as shown in FIG. 1.

Ideally, the extrusions illustrated in FIGS. 6 and 7 are made of aluminum having a thickness of approximately ⅛". The overall length of the support plate 22, including the track-engaging flange 24, is approximately nine to nine and one-half inches long; and the overall length of the foot pedal portion 28 from the bend 29 to the outer edge of the C-shaped hinge portion 32, is approximately six and one-half inches long. The width of the starting blocks typically are between five and six inches, which has been found to be a comfortable width for use with most athletes. As a consequence, it can be seen that the portable starting block 20 which has been shown and described above may be folded into a readily transportable, easily carried package. It is much smaller in bulk and weight than conventional starting blocks and yet serves its purpose in a manner far superior to the bulky fixed configuration starting blocks used in the past.

The sprayed-on non-skid polyurethane coating layer 34 also has been found to be superior to the prior art uses of carpeting or rubber foam on the facing surface of the pedals. Track spikes tear holes in both carpet and rubber foam, necessitating frequent replacement of these facing surfaces on conventional starting blocks. The sprayed polyurethane layer 34 is significantly more resistant to tearing and provides the necessary resistance against the spikes of track shoes for proper starts, without being penetrated by those spikes.

The foregoing description of the preferred embodiment is to be considered as illustrative and not as limiting. Various changes and modifications will occur to those skilled in the art for performing substantially the same the function, in substantially the same way, to achieve substantially the same result without departing from the true scope of the invention as defined in the appended claims.

What is claimed is:

1. A portable athletic starting block including in combination:

a foot pedal portion having a transverse track-engaging flange on one and having an upper end;

a support plate portion having a transverse track-engaging flange on one end and having an upper end;

mating rotatable interconnect members on the upper ends of the foot pedal portion and the support plate portion to interconnect the foot pedal portion and the support plate portion for predetermined rotational movement of the track-engaging ends thereof toward and away from one another to adjust the angle of the foot pedal portion with respect to a track surface.

2. The starting block according to claim 1 wherein the track-engaging flange of the foot pedal portion is turned inwardly toward the support plate portion when the starting block is in position on a track.

3. The starting block according to claim 2 wherein at least the foot pedal portion and the support plate portion both comprise sections of extrusions.

4. The starting block according to claim 3 further including a frictional surface on the outwardly facing portion of the foot pedal portion of the starting block.

5. The starting block according to claim 4 wherein the friction portion comprises a polyurethane layer adhered to the foot engaging surface of the foot pedal portion of the starting block.

6. The starting block according to claim 5 wherein the foot pedal portion has a generally concave outwardly facing surface for engagement of a foot of user of the starting block.

7. The starting block according to claim 6 wherein the mating rotatable interconnect members comprise mating elongated locking members having a uniform cross section at all points along the lengths thereof.

8. The starting block according to claim 7 wherein the mating rotatable interconnect members comprise elongated extrusions extending transversely across the upper ends of the foot pedal portion and the support plate portion, and integral therewith, each of which interconnect members have a generally C-shaped cross section throughout the length thereof, with one of the interconnect members nesting inside the other of the interconnect members and configured such that the foot pedal portion and the support plate portion are capable of a predetermined limited rotation about the mating rotatable interconnect members from one position where the track-engaging end of the foot pedal portion substantially underlies the support plate portion adjacent thereto to another position where the track-engaging ends of the foot pedal portion and the support plate portion are at a maximum distance apart.

9. The starting block according to claim 8 wherein the mating rotatable interconnect members engage one another by sliding engagement thereof until alignment of the foot pedal portion and the support plate portion with one another is achieved, and further including a locking member to prevent accidental separation of the mating rotatable interconnect members from one another.

10. The starting block according to claim 9 wherein the mating rotatable interconnect members comprise an inner member on one of the foot pedal portion and the support plate portion and an outer member on the other of the foot pedal portion and the support plate portion, whereupon the locking member engages the inner member of the interconnect members.

11. The starting block according to claim 10 wherein the foot pedal portion and the support plate portion extrusions are made of aluminum.

12. The starting block according to claim 11 further including track-engaging members on the track-engaging ends of the foot pedal portion and the support plate portion of the starting block.

13. A portable athletic starting block including in combination:

a foot pedal portion having a track-engaging end and an upper end;

a support plate portion having a track-engaging end and an upper end;

mating rotatable interconnect members comprising mating elongated locking members having a uniform cross section at all points along the lengths thereof on the upper ends of the foot pedal portion and the support plate portion to interconnect the foot pedal portion and the support plate portion for predetermined rotational movement of the track-engaging ends thereof toward and away from one another to adjust the angle of the foot pedal portion with respect to a track surface.

14. The starting block according to claim 13 wherein the mating rotatable interconnect members comprise elongated extrusions extending transversely across the upper ends of the foot pedal portion and the support plate portion, and integral therewith, each of which interconnect members have a generally C-shaped cross section throughout the length thereof, with one of the interconnect members nesting inside the other of the interconnect members and configured such that the foot pedal portion and the support plate portion are capable of a predetermined limited rotation about the mating rotatable interconnect members from one position where the track-engaging end of the foot pedal portion substantially underlies the support plate portion adjacent thereto to another position where the track-engaging ends of the foot pedal portion and the support plate portion are at a maximum distance apart.

15. The starting block according to claim 14 wherein the mating rotatable interconnect members engage one another by sliding engagement thereof until alignment of the foot pedal portion and the support plate portion with one another is achieved, and further including a locking member to prevent accidental separation of the mating rotatable interconnect members from one another.

16. The starting block according to claim 15 wherein the mating rotatable interconnect members comprise an inner member on one of the foot pedal portion and the support plate portion and an outer member on the other of the foot pedal portion and the support plate portion, whereupon the locking member engages the inner member of the interconnect members.

17. The starting block according to claim 13 further including a frictional surface on the outwardly facing portion of the foot pedal portion of the starting block.

18. The starting block according to claim 17 wherein the foot pedal portion has a generally concave outwardly facing surface for engagement of a foot of user of the starting block.

19. The starting block according to claim 13 further including track-engaging members on the track-engaging ends of the foot pedal portion and the support plate portion of the starting block.

20. The starting block according to claim 13 wherein at least the foot pedal portion and the support plate portion both comprise sections of extrusions.

21. The starting block according to claim 20 wherein the foot pedal portion and the support plate portion extrusions are made of aluminum.

22. The starting block according to claim 21 wherein the mating rotatable interconnect members comprise elongated extrusions extending transversely across the upper ends of the foot pedal portion and the support plate portion, and integral therewith, each of which interconnect members have a generally C-shaped cross section throughout the length thereof, with one of the interconnect members nesting inside the other of the interconnect members and configured such that the foot pedal portion and the support plate portion are capable of a predetermined limited rotation about the mating rotatable interconnect members from one position where the track-engaging end of the foot pedal portion substantially underlies the support plate portion adjacent thereto to another position where the track-engaging ends of the foot pedal portion and the support plate portion are at a maximum distance apart.

23. The starting block according to claim 13 wherein the mating rotatable interconnect members engage one another by sliding engagement thereof until alignment of the foot pedal portion and the support plate portion with one another is achieved, and further including a locking member to prevent accidental separation of the mating rotatable interconnect members from one another.

24. A portable athletic starting block including in combination:

a foot pedal portion having a track-engaging end and an upper end;

a support plate portion having a track-engaging end and an upper end;

mating rotatable interconnect members on the upper ends of the foot pedal portion and the support plate portion to interconnect the foot pedal portion and the support plate portion for predetermined rotational movement of the track-engaging ends thereof toward and away from one another to adjust the angle of the foot pedal portion with respect to a track surface, wherein the mating rotatable interconnect members comprise elongated extrusions extending transversely across the upper ends of the foot pedal portion and the support plate portion, and integral therewith, each of which interconnect members have a generally C-shaped cross section throughout the length thereof, with one of the interconnect members nesting inside the other of the interconnect members and configured such that the foot pedal portion and the support plate portion are capable of a predetermined limited rotation about the mating rotatable interconnect members from one position where the track-engaging end of the foot pedal portion substantially underlies the support plate portion adjacent thereto to another position where the track-engaging ends of the foot pedal portion and the support plate portion are at a maximum distance apart.

* * * * *